US005244302A

United States Patent [19]

Ollivier

[11] Patent Number: 5,244,302

[45] Date of Patent: Sep. 14, 1993

[54] TEMPORARY ROAD SIGN COMPONENT

[76] Inventor: Jean Ollivier, Le Plessis, 85290 Mortagne sur Sevre, France

[21] Appl. No.: 789,270

[22] Filed: Nov. 8, 1991

[30] Foreign Application Priority Data

Nov. 28, 1990 [FR] France ..... 90 14866

[51] Int. Cl.[5] ..... E01F 9/00

[52] U.S. Cl. ..... 404/10; 40/606; 116/63 P

[58] Field of Search ..... 404/6, 9, 10; 116/63 P, 116/63 R; 40/606, 612; 256/13.1; 340/473, 908

[56] References Cited

U.S. PATENT DOCUMENTS 3,795,220 3/1974 Hengesbach ..... 116/63 P
3,868,630 2/1975 Lesondak ..... 40/606 X
3,950,873 4/1976 Stehle ..... 116/63 P
4,183,695 1/1980 Wilcox ..... 40/606 X
4,411,085 10/1983 Farmer ..... 40/610
4,792,258 12/1988 Goff ..... 404/10 X

FOREIGN PATENT DOCUMENTS 3434868 4/1986 Fed. Rep. of Germany .

*Primary Examiner*—Ramon S. Britts
*Assistant Examiner*—Roger J. Schoeppel
*Attorney, Agent, or Firm*—Sixbey, Friedman, Leedom & Ferguson

[57] ABSTRACT

A temporary road sign component or the like, comprising a panel integral with a stand for standing on the ground, with its base including at least two lengths of tube orthogonal to the panel and directed to rest on the ground via respective generator lines, and suitable for receiving substantially cylindrical ballasting pieces therein.

3 Claims, 1 Drawing Sheet

TEMPORARY ROAD SIGN COMPONENT

The present invention relates to a temporary road sign component such as a panel or a barrier marking off an area that is temporarily dangerous or to which access is barred, e.g. because of road works.

BACKGROUND OF THE INVENTION

Numerous types of road sign exist for performing this function, they may be made of metal or of plastic and they are stood on the ground by means of an appropriate stand providing a stand area or "footprint" which is large enough to ensure that the road sign is stable. The need to have a large footprint gives rise to devices that are relatively bulky and which are difficult to store and to transport. In addition, it is often essential to ballast the bases of such devices or to reinforce their stability on the ground some other way by such means as happen to be available on the worksite about which warning is to be given. Such means (wedges, stones, heavy objects, . . . ) are never adapted to securing such panels properly, and as a result they do not perform effectively for very long and they end up obstructing the roadway because of unwanted displacements.

The invention seeks to remedy these drawbacks by proposing equipment which is adapted firstly to installing a road sign whose stability is ensured in a manner which is both effective and permanent by simple means that are often available on site, and secondly to enabling road signs to be stored and transported in a reduced volume.

SUMMARY OF THE INVENTION

To this end, the present invention provides a temporary road sign component or the like, comprising a panel integral with a stand for standing on the ground, in which the base of the stand includes at least two lengths of tube orthogonal to the panel and directed to rest on the ground via respective generator lines, and suitable for receiving substantially cylindrical ballasting pieces therein.

Preferably, the ballasting piece is constituted by a deformable cylindrical bag filled with a heavy divided material and longer than the length in which it is received.

In one embodiment, the component is in the form of a thinwalled open box fitted with the tubes at two adjacent corners, with the axes of the lengths of tube being substantially perpendicular to said wall.

In this embodiment, in order to enable the components to be stored compactly, each stand is delimited by two stackable surfaces.

Finally, in a particular embodiment, the panel is integral with the base and is constituted by a thin wall delimited by two stackable surfaces that are continuous with the surfaces delimiting the stand.

BRIEF DESCRIPTION OF THE DRAWING

Embodiments of the invention is described by way of example with reference to the accompanying drawing, in which.

DETAILED DESCRIPTION

Figure 1:
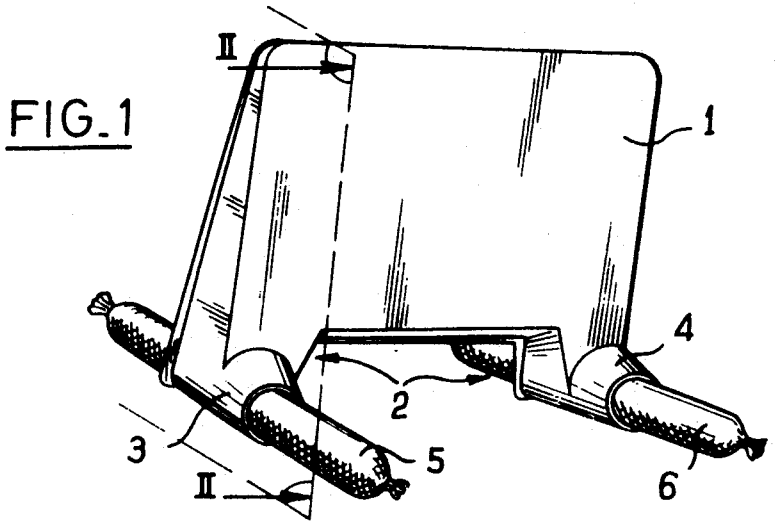
FIG. 1 is an outside view of a road sign component of the invention in which the panel and the stand constitute a single piece.
Figure 2:
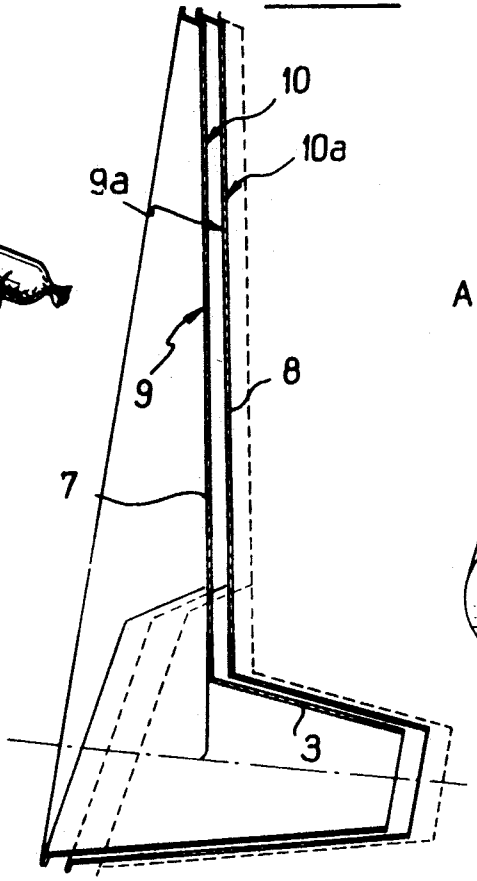
FIG. 2 is a section on plane II—II of FIG. 1.
Figure 3:
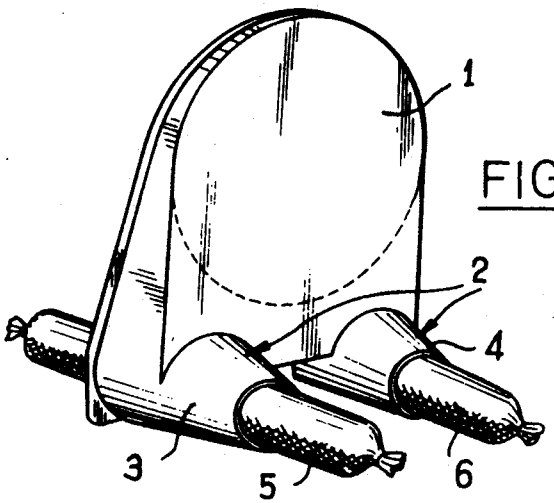
FIG. 3 shows a road sign component having a different shape of panel.

A road sign component of the invention comprises a panel 1 whose outline corresponds to one of the standardized outlines for road signs, e.g. a rectangle as in FIG. 1 or a circle as in FIG. 2 (or it could be hexagonal, triangular, . . . ), together with a stand 2 which is integrally formed with the panel 1 in the embodiment shown in FIGS. 1 to 3.

In these FIGS. 1 to 3, the stand is essentially constituted by two tapering lengths of tube 3 and 4 whose axes are practically orthogonal to the plane of the panel 1. These lengths of tube constitute housings for ballasting pieces 5 and 6 which are inserted therein. These ballasting pieces are in the form of cylindrical sleeves made of flexible material (cloth, plastic sheeting, . . . ) filled with a heavy divided material such as sand, gravel, earth, . . . . These ballasting pieces may be made up on site using flexible "socks" which are stored flat (or in lengths) and which are thus easily stored and transported, with material available on the worksite being used to fill them, and with two ties to close off the ends of the "sand bags" constituted in this way. The lengths of such sand bags 5 and 6 may be determined by the manufacturer or by the user, but in any event they are significantly longer than the axial length of the lengths of tube in order to ensure that the road sign component is securely held on the ground.

It will be understood that these deformable ballast components have the advantage of being able to deform to accommodate any unevenness of the ground while nevertheless conferring excellent stability to the panel. In addition, these ballast components can be discarded after use and they do not waste space pointlessly in storage depots or in transport vehicles. The diameter of each bag is adapted to penetrate easily into the tubular lengths 3 or 4, or to jam slightly therein should that turn out to be useful.

Figure 4:
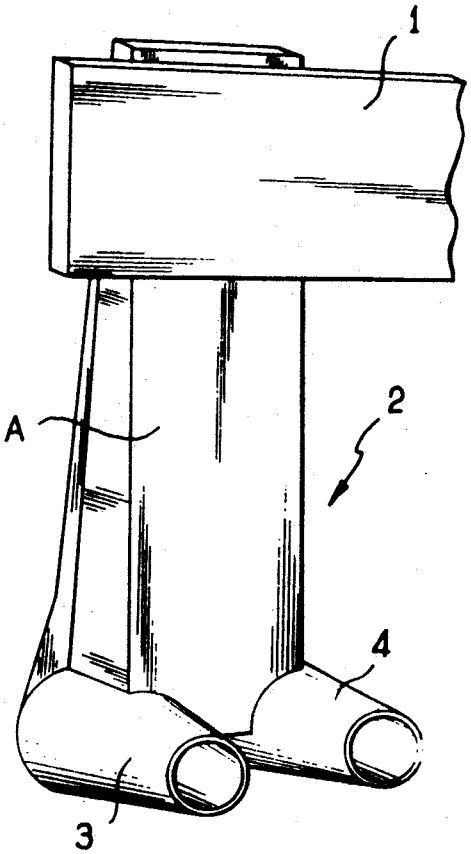
FIG. 4 shows a portion of a barrier type road sign component in which the panel and the stand are separate parts.

FIG. 4 shows a post A of a stand 2 fitted with tapering lengths of tube 3 and 4, with the post A and at least one other identical post being suitable for constituting the stand of a barrier 1 (replacing the panel). The varrier is not constituted by a single piece, but is secured to the tops of the post A by dismountable fixing means, not shown.

The stand, or the entire component if it is made as a single piece, can be manufactured from any appropriate material, and in particular it can be made of plastic. In addition, it is advantageous to give it the structure of an open thin-walled box whose wall also forms the walls of the lengths of tube.

It is thus possible to form such a thin wall which is stiffened by its box structure integrally with the tubes of its base that rest on the ground in such a manner that the two resulting complex surfaces can be stacked together as shown in FIG. 2.

This figure is a section through two road sign components or stands of the invention 6 and 7 which are identical and which are stacked one in the other to illustrate the way in which the two surfaces 9 & 10 and 9*a* & 10*a* delimiting each of these parts are suitable for being stacked together. In other words, the surface 9 of the component 7 is substantially concave or hollow whereas its surface 10 which is preferably the surface carrying the symbols of the road sign is convex and can be received in the concave surface 9*a* (identical to 9) of an adjacent component 8. FIG. 2 also shows that the lengths of tube are tapering to enable them to be stacked in one another.

This shows how road signs or road sign stands can be stored compactly by performing the present invention.

I claim:

1. A temporary road sign component comprising:

a stand;

a panel integrally formed with said stand; and a supporting means for supporting said panel and stand, said supporting means including a ballasting receiving means, said ballasting receiving means including at least two lengths of open tube substantially orthogonal to said panel with said two lengths of open tube having ballasting pieces received therein which have a length longer than that of said two lengths of tube, and wherein each of the ballasting pieces includes a deformable cylindrical bag filled with a heavy divided material, the ballasting pieces having a length longer than that of said two lengths of tube wherein said ballasting pieces extend beyond each end of said two lengths of tube.

2. A component according to claim 1, wherein each stand is delimited by two stackable surfaces.

3. A component according to claim 2, wherein the panel is integral with the supporting means and is constituted by a thin wall delimited by two stackable surfaces that are continuous with the surfaces delimiting the stand.

* * * * *